US006758760B1

(12) United States Patent
Kellogg et al.

(10) Patent No.: US 6,758,760 B1
(45) Date of Patent: Jul. 6, 2004

(54) GOLF CLUB SWING AIDING DEVICE

(76) Inventors: Norman D. Kellogg, 12862 Sylvan St., Garden Grove, CA (US) 92845; Eugene J. Albertini, 3355 via Lido, Suite 360, Newport Beach, CA (US) 92663

( * ) Notice: Subject to any disclaimer, the term of this patent is extended or adjusted under 35 U.S.C. 154(b) by 0 days.

(21) Appl. No.: 10/383,481

(22) Filed: Mar. 6, 2003

(51) Int. Cl.[7] ..... A63B 69/36
(52) U.S. Cl. ..... 473/220
(58) Field of Search ..... 473/220, 221, 473/222, 223, 226, 202, 219, 240

(56) References Cited

U.S. PATENT DOCUMENTS 4,930,785 A * 6/1990 Mills ..... 473/202
5,217,228 A * 6/1993 De Aguilar ..... 473/220
5,464,222 A * 11/1995 Carney ..... 473/220
5,467,991 A * 11/1995 White et al. ..... 473/220
5,472,204 A * 12/1995 English et al. ..... 473/220
5,494,290 A * 2/1996 Stefanoski ..... 473/220
5,759,110 A * 6/1998 Seibel et al. ..... 473/220
5,788,582 A * 8/1998 Shapiro ..... 473/220
5,897,441 A * 4/1999 Apthorp ..... 473/220
6,059,668 A * 5/2000 Marley, Jr. ..... 473/220

* cited by examiner

*Primary Examiner*—Stephen P. Garbe
*Assistant Examiner*—Nini F. Legesse
(74) *Attorney, Agent, or Firm*—Drummond & Duckworth

(57) ABSTRACT

An improved club swing training device is provided for assisting persons, such as golfers to improve their golf swing. The training aid includes a power source, a light source such as a laser beam, a light deflector such as a mirror and a motor for rotating the light deflector. The light source, light deflector and motor are affixed to the proximal end of a club shaft. In operation, the light source strikes the light deflector which is rotated by the motor. The light deflector is angled relative to the axis of the light source's emitted beam so that upon the beam striking the light deflector, it is redirected in a second direction so as to form a fan of light as the motor rotates the light deflector. The swing training aid includes a scabbard for affixing the motor, light deflector and light source to the proximal end of a club and for positioning these components so as to position the fan of light so as to assist a person in seeing their club swing.

9 Claims, 5 Drawing Sheets

GOLF CLUB SWING AIDING DEVICE

BACKGROUND OF THE INVENTION

The present invention relates to practice aids for assisting persons to improve their swings. More particularly, the present invention relates to practice aids for teaching persons proper alignment when swinging a sporting club or the like. There are many examples of clubs which are used to hit an object towards a target including the baseball bat, tennis racquet, squash racquet, ping pong paddle, croquet club, etc. However, the device is believed to have particular application to assisting persons in improving their golf swing. Because the present invention is believed to have particular application to improving a golf swing, the invention is described with particularity for golfing applications. However, the invention is not intended to be limited thereto.

Golf clubs include a shaft and club head which are used to hit a stationary ball towards a golf course green. The golf club's shaft has a proximal extremity and a distal extremity, and the club head is mounted to the shaft's distal extremity. In most circumstances, the club head is substantially planar and transverse to the target line which extends towards a target.

A successful strike of a golf ball is dependant upon the alignment or orientation of the club head impact surface at the point of contact with the ball. If the impact surface is not perfectly transverse to the target line, then the ball will not travel in an intended direction. During a golf club back swing, it is necessary to rotate your hands in a clockwise direction (for a right-handed person), and then rotate your hands in a counterclockwise direction during the forward swing such that the club head arrives at a square position at the point of impact. Such movement of the club head during the back swing, forward swing and follow through, is extremely difficult to achieve. Furthermore, the fact that the club head is traveling at a great velocity makes it extremely difficult to gauge the position of the club head during the swing.

In the past, a great number of devices have been proposed which attempt to indicate the orientation of the club head during a golf swing. Most such devices include the use of a light source that directs a beam of light for representing golf club orientation and golf club swing path. For example, U.S. Pat. Nos. 6,149,537 and 6,149,531 describe golf putters which include a laser contraption. A laser diode or the like transmits a beam downwardly from the handle of the club to project a beam of light near the golfer's feet. Swinging the club causes the beam to define and illustrate the golfer's swing path. Optionally, the contraption includes an additional glass rod positioned in front of the laser to project a path of light. Unfortunately, when transmitted in a beam, the device does not provide an adequate reflection of swing path. Meanwhile, the glass rod diffracts the laser to present a path which is insufficient to reflect swing path.

Alternatively, U.S. Pat. No. 3,953,034 describes an apparatus which includes a laser device and a mirror which projects a fan shaped beam along the ground ahead of a club face. The device is intended to enable a user to see the line of light on the ground as the ball is hit so that the golfer can determine whether the ball is being hit straight, with a hook, or with a slice. U.S. Pat. No. 5,467,991 discloses a device for attachment to an actual golf club. The device transmits a light beam which traces a straight line behind the ball during the back swing and an oppositely directed light beam picks up the same line when the golf club is properly swung as the club approaches the top of the back swing. Additionally, U.S. Pat. No. 5,288,080 describes a golf club which has been modified to include strobing lights which are emitted from the club head's top surface. These strobing lights provide a path of light illustrating the club's angle and path during the golfer's swing. Still an additional golf aid is described in U.S. Pat. No. 5,207,429. This reference describes a laser apparatus which attaches and detaches to a traditional golf putter. A prism is provided so as to project the laser into a path of light as opposed to a mere beam of light.

Unfortunately, each of the above-described swing aiding devices suffer from distinct disadvantages. For example, several of the devices do not provide an indication of club head position during the full swing. An additional disadvantage is that several of the devices require significant modifications to an existing club head. Such arrangements are complex and costly to manufacture and may not be readily adapted to an existing golf club.

It is therefore an object of the invention to overcome the above-described disadvantages by providing a swing aid which is inexpensive to manufacture and which can be used in cooperation with a standard sporting club.

It is still an additional object of the invention to provide a golf club swing aid which provides an indication of club head orientation and path throughout a golfer's entire back swing, forward swing and follow-through.

SUMMARY OF THE INVENTION

Briefly, in accordance with the invention, I provide a swing aid device for a sporting club having a shaft. The device includes a housing affixed to the club's shaft. Within the housing, the device includes a light source for emitting a beam of light. The light source may be any type known to those skilled in the art, but preferably it is a laser diode which transmits a laser beam in a first direction. The device further includes a light deflector positioned in the path of the light beam. The deflector may be a refractor such as a prism or a reflector such as a mirror for deflecting the light beam into a second direction. In addition, the swing aiding device includes a motor attached to the light deflector for rotating the light deflector. The motor rotates the light deflector at sufficient velocity so that a beam striking the light deflector is rotated at a sufficient velocity so as to provide the visual appearance of a fan of light. Moreover, the rotation of the light deflector causes the light beam to visually appear as a luminescent line when striking an object, such as the ground.

The sporting club swinging aid device of the present invention may be affixed to the shaft of numerous types of sporting clubs including, but not limited to, baseball bats, ping pong paddles, croquet clubs, tennis racquets and squash racquets. However, the device is believed to have particular application to assisting persons in swinging a golf club.

To this end, preferably the swing aiding device is affixed to the golf club shaft so as to project a fan of light in a plane substantially parallel and approximately 2"–3" from the club head's impact face. Alignment of the light source of the swing aiding device in such a manner is particularly suited for assisting golfers to analyze and improve their full swing. Alternatively, the swing aiding device may be constructed and affixed to the golf club shaft so that the fan of light is perpendicular to the club head's impact face. This construction is considered ideal for assisting persons when swinging a golf putter.

In a preferred embodiment of the invention, the club swing aiding device includes a substantially "C" shaped scabbard for affixing the device's housing, including motor, light source and light deflector, to the golf club's shaft's proximal extremity. The "C" shaped scabbard includes first and second ends. Each of the ends are constructed to attach and detach to the cylindrical shape of a traditional golf club shaft. Various constructions for affixing to a golf club shaft can be determined by those skilled in the art. Meanwhile, the "C" shaped scabbard is constructed so that its intermediate portion projects substantially parallel to the golf club shaft. The scabbard further forms an opening of sufficient size to enable a golfer's hands to project through the opening so as to grip the golf club's shaft in a manner suitable and conducive to swinging the golf club in a traditional manner. The light source, light deflector and motor are all affixed to the scabbard so as to project a fan of light parallel or perpendicular to the face of the golf club head, depending on whether one is practicing their putting stroke or full swing.

It is thus an object of the present invention to provide an inexpensive device for assisting persons in perfecting their sporting club swing.

It is still an additional object of the present invention to provide a device which can be used to modify traditionally constructed sporting clubs.

It is still an additional object of the invention to provide a club swing aiding device which provides persons with an indication of their club swing and club orientation during club back stroke, forward stroke and follow through.

These and other and more specific objects and advantages of the invention will be apparent to those skilled in the art from the following detailed description taken in conjunction with the drawings.

DETAILED DESCRIPTION OF THE INVENTION

Figure 1:
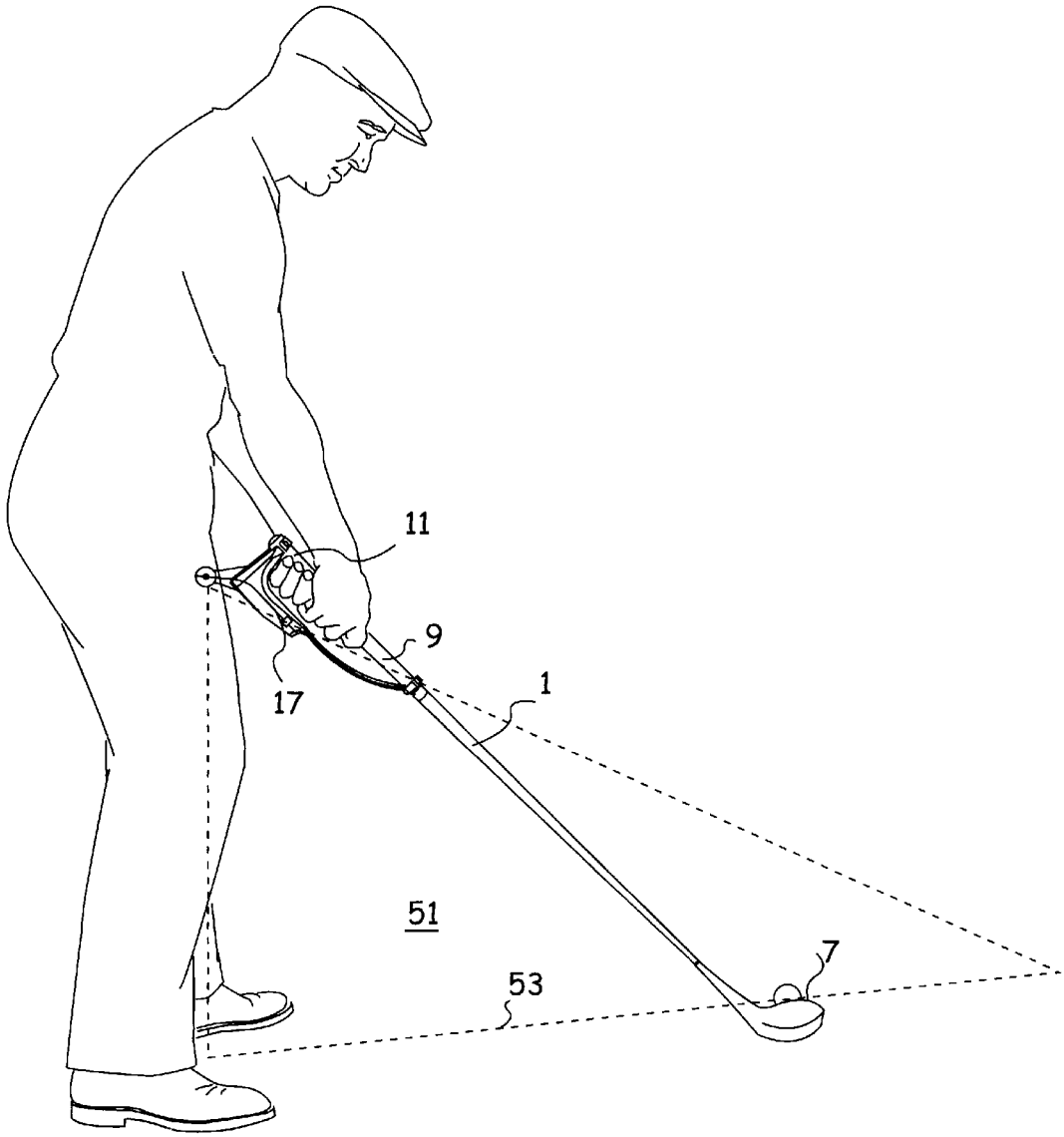
FIG. 1 is a perspective view illustrating an individual using the golf club swing aiding device of the present invention.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated. For example, the swing aiding device is described with particular application for attachment to a golf club, and for use in assisting a golfer in improving his golf swing. However, the invention is believed to have application for assisting persons in improving their swing of other objects, including baseball bats, cricket clubs, ping pong paddles, croquet mallets, tennis racquets, squash racquets, etc.

With reference to FIG. 1, the training aid 17 of the present invention affixes to the golf club's handle 9 located at the proximal end 11 of a golf club 1. With reference to FIGS. 2–5, the training aid 17 includes one or more housings for encapsulating and protecting the electrical and mechanical components of the training aid. In a preferred embodiment, the training aid 17 includes a first housing 25 for encapsulating and protecting the power source 41, in the form of batteries, and on/off switch 49. The housing may be constructed in various forms as can be determined by those skilled in the art. However, as shown in the figures, in a preferred embodiment, the housing 25 is constructed with a first half 27 and a second half 29 which may be separated for access to the power source and switch, or affixed together using fasteners known to those skilled in the art.

The training aid 17 of the present invention preferably includes a second housing 35, also constructed to include a first half 37 and second half 39. Preferably, the second housing is spaced apart from the first housing 25 by an extension arm 33 for positioning the second housing 35 in an ideal position. Within the second housing 35, the training aid includes a light source 43, a light deflector 45 and a motor 47. The light source 43 and motor 47 are connected to the power source 41 and switch 49 through an electrical harness system not shown.

Figure 4:
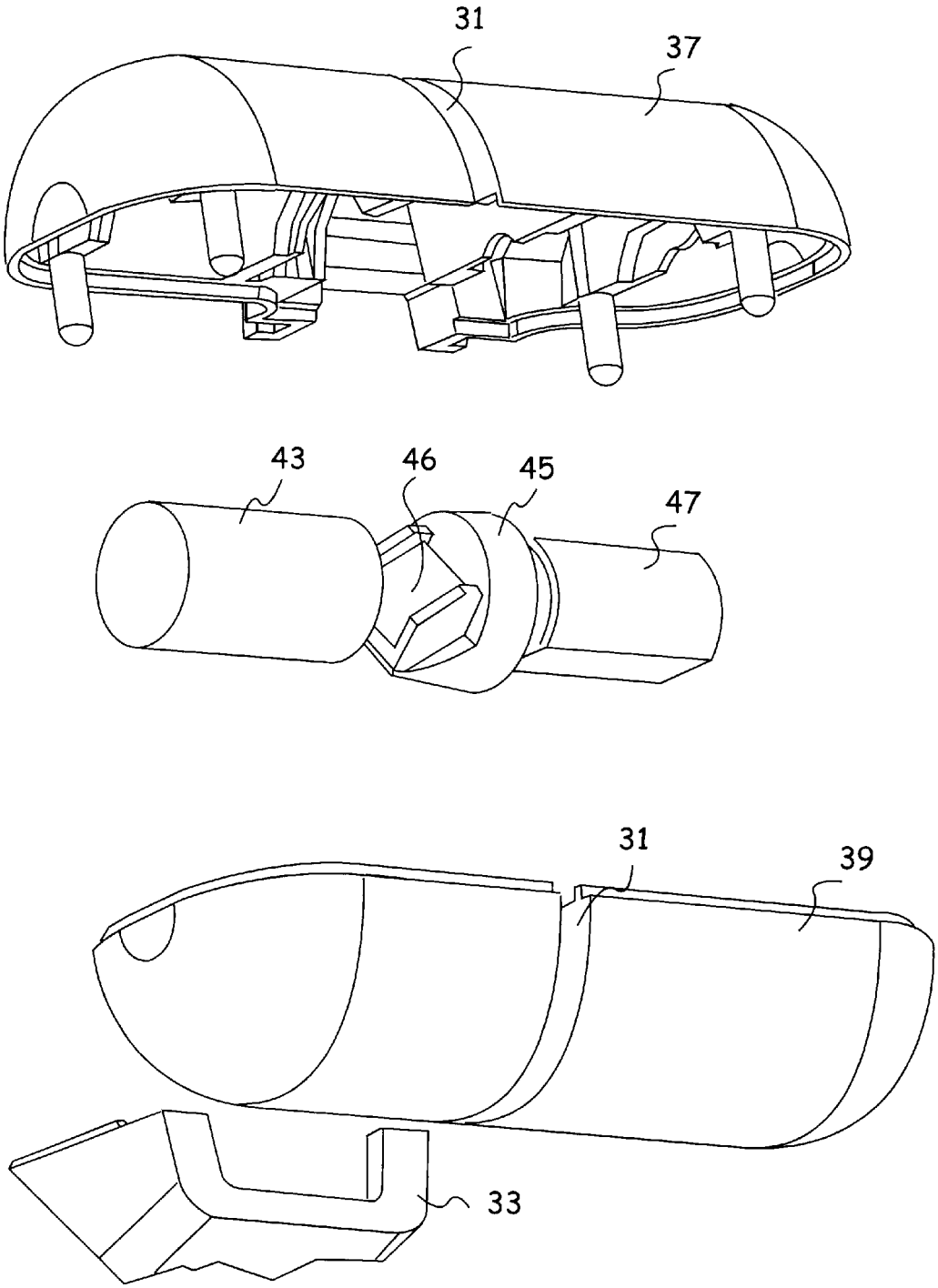
FIG. 4 is a perspective exploded view illustrating the housing, laser, light deflector and motor of the golf club swing aiding device of the present invention.
Figure 5:
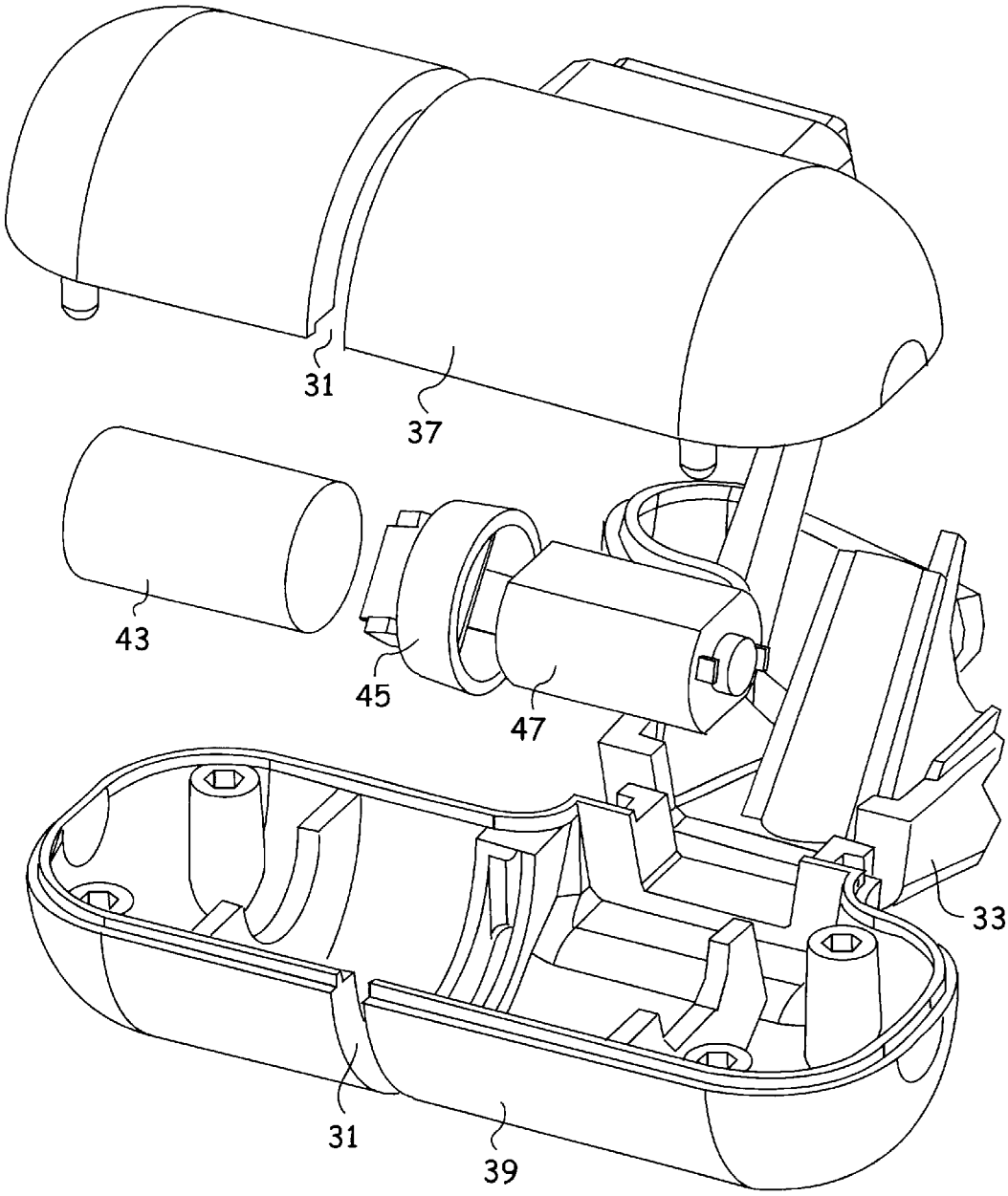
FIG. 5 is a second perspective exploded view illustrating the housing, laser, light deflector and motor of the golf club swing aiding device of the present invention.

With particular reference to FIGS. 4 and 5, the light source preferably is a laser 43 positioned so as to emit a laser beam that strikes the light deflector 45 which deflects the light from the beam's initial path into a second path. As shown in the figures, the light deflector may be constructed in the form of a mirror 46; however, alternative reflectors or refractors may also be used to deflect the laser beam's initial path. Meanwhile, the motor 47 includes a rotating shaft (not shown) to which the light deflector 45 is affixed. When powered, the motor 47 rotates the light deflector 45 so that the laser beam emitted from the light deflector is caused to rotate 360°. The light deflector may be positioned at any angle other than 0° and 90° relative to the laser's beam. However, preferably, and as shown in the drawings, the motor's axis of rotation is coincident with the laser beam's axis, and the light deflector's mirror 46 is positioned 45° relative to the laser beam and motor's axis so that the laser beam's second path is angled 90° relative to the beam's initial path. As can be understood by those skilled in the art, the alignment and positioning of the laser, light deflector and motor causes the laser beam to project outwardly in a plane through a slot 31 formed in the housing 35.

Figure 2:
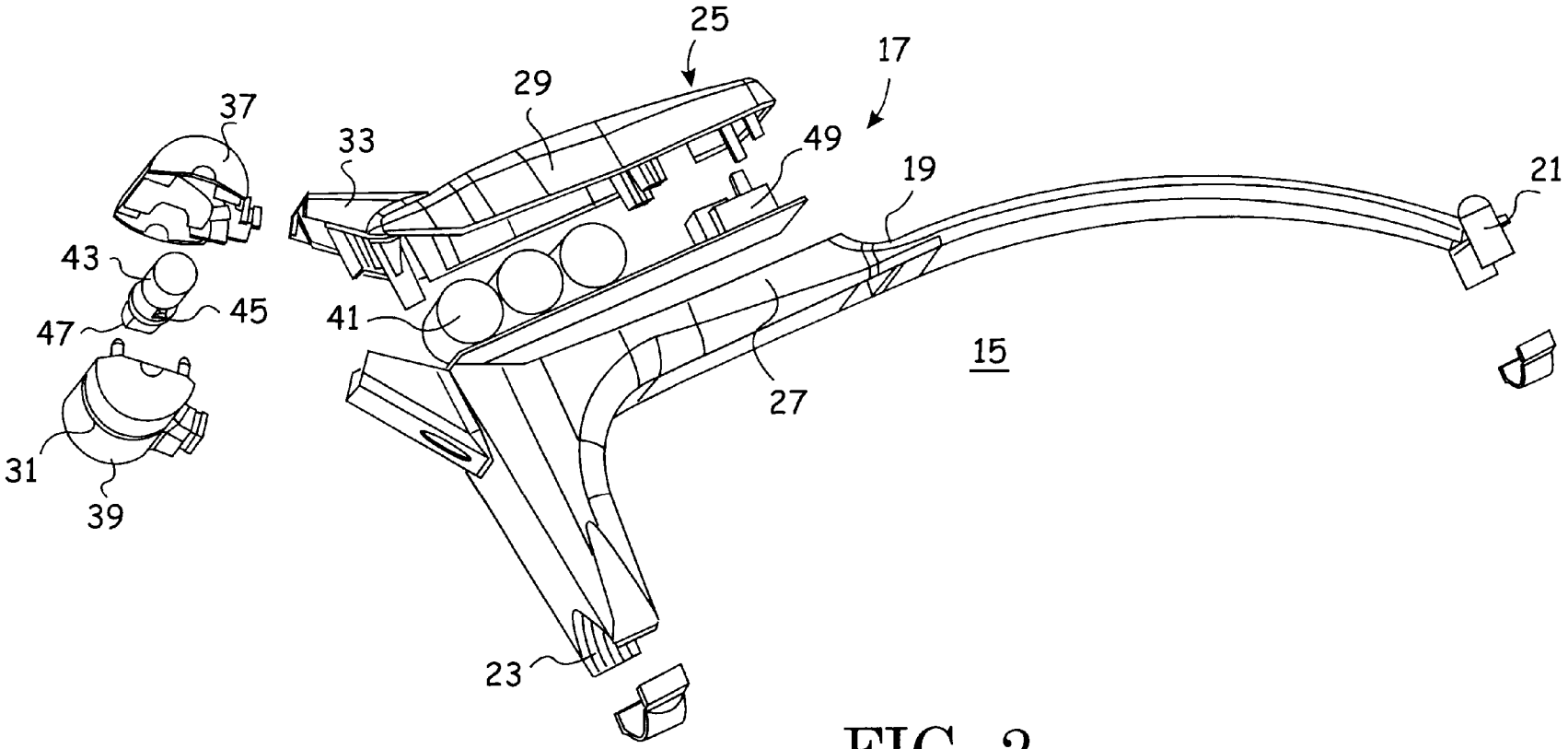
FIG. 2 is a side exploded view illustrating the internal components of the golf club swing aiding device of the present invention.
Figure 3:
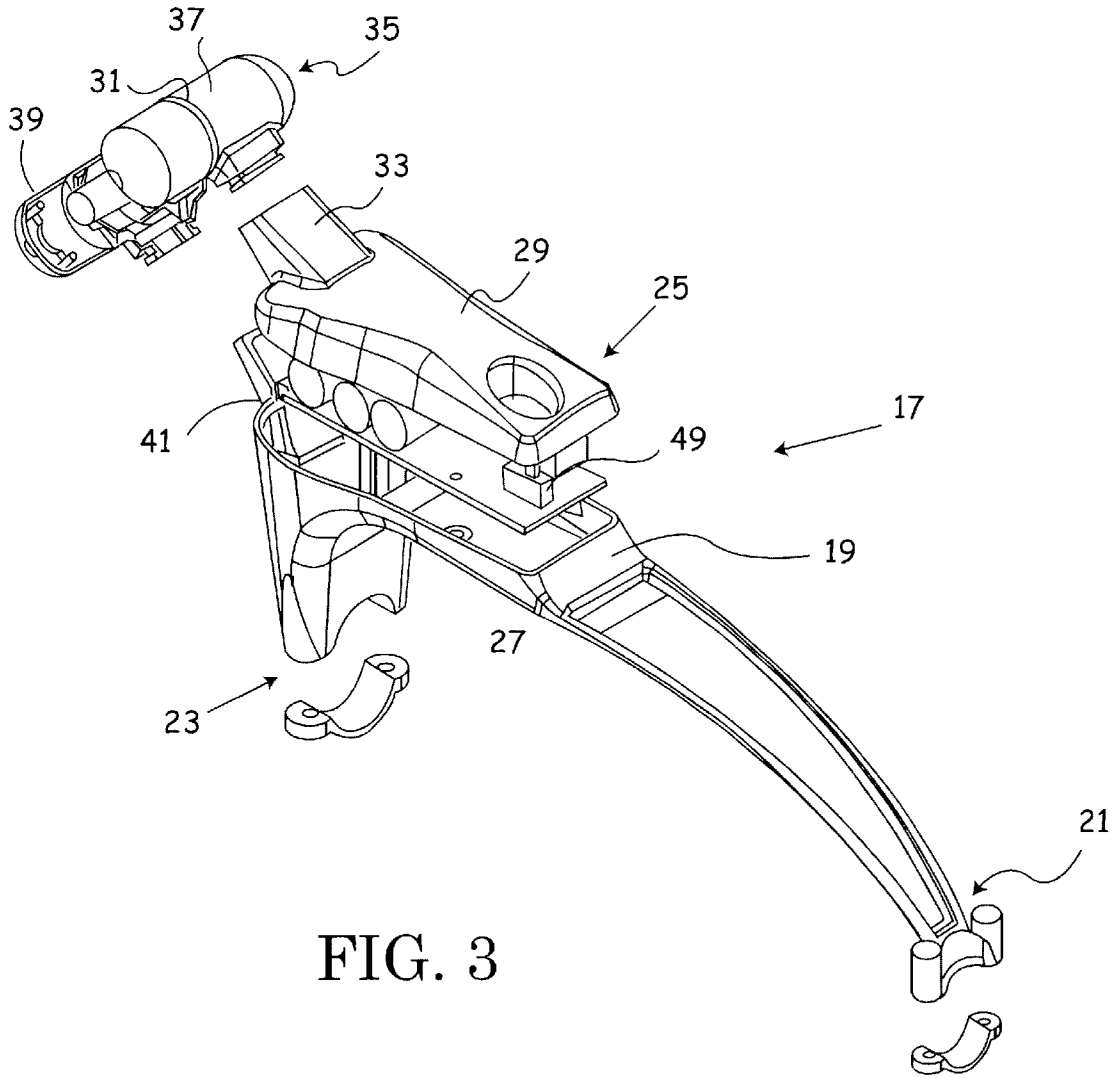
FIG. 3 is a perspective exploded view illustrating the components of the golf club swing aiding device of the present invention.

With reference to FIGS. 1–3, the respective housings 25 and 35 are preferably affixed to a club 1 by a scabbard construction 19. The scabbard is generally "C" shaped for affixing and properly positioning the training aid's motor, laser, light deflector, power source and switch so as to project a rotating laser beam relative to the club head's impact face 7. The scabbard includes first and second ends, 21 and 23 respectively, which are constructed to attach to the proximal end 11 of a golf club 1. Constructions and means for affixing the scabbard to a golf club can be determined by those skilled in the art. However, in a preferred embodiment, the scabbard is affixed to the golf club using a clamp and threaded fastener construction. With reference to FIG. 1, the "C" shaped scabbard is further constructed so that its intermediate portion projects substantially parallel to the golf club. Accordingly, the scabbard forms an opening 15 which is of sufficient size so as to receive a golfer's fingers so that a golfer may properly grip the golf club's shaft in a manner suitable and conducive to swinging the golf club in a traditional manner.

The light source, light deflector and motor are affixed to the scabbard so as to project a fan of light parallel or perpendicular to the golf club's impact surface 7, depending on whether one is practicing their putting stroke or full swing. For example, FIG. 1 illustrates the mounting of the light source, light deflector and motor so as to project a fan of light 51 parallel and approximately 2" from the golf club's face 7. This construction is considered ideal for assisting a golfer in improving his full swing. The fan of light 51 forms a line of light 53 when it strikes an object, such as the ground. Upon the golfer's back swing, the line of light rotates with the golfer's wrists so as to rotate the laser line 90° from its original position so as to reflect a golfer's ideal swing path.

While a preferred embodiment of the invention has been illustrated and described, it will be apparent to those skilled in the art that various modifications can be made without departing from the spirit and scope of the invention. For example, the training aid 17 may be constructed with numerous alternative components. For example, the scabbard 17, and housings 25 and 35 may be constructed in various shapes and of various materials. However, it is preferred that the scabbard and housings be constructed of lightweight materials such as plastic. Meanwhile, various light sources may be used. However, it is preferred that a laser be incorporated into the swing training aid having an output which is sufficiently high so as to see the laser line in moderate lighting conditions while not providing a risk to a person's vision if the laser beam inadvertently is directed to a person's eye. Meanwhile, various electrical motors can be used for practicing the present invention. It is preferred that the motor rotate at a sufficient rotational velocity so that the laser beam appears as a line on the ground, rather than as a moving dot. Accordingly, it is not intended that the invention be limited except by the following claims.

Having described my invention in such terms as to enable those skilled in the art to understand and practice it, and having defined and identified the presently preferred embodiments thereof, I claim:

1. A sporting club swing training device comprising:

a shaft;

a light source emitting a beam of light in a first direction;

a light deflector positioned so that said beam strikes said light deflector to redirect said beam into a second direction; and a motor for rotating said deflector so that said beam in said second direction rotates in a plane, said motor rotating at a velocity sufficient that said beam forms a planar fan of light and appears to form a luminescent line when striking the ground.

2. The sporting club swing training device of claim 1 wherein said light deflector is a mirror.

3. The sporting club swing training device of claim 1 wherein said light deflector is a prism.

4. The sporting club swing training device of claim 1 wherein said shaft forms part of a golf club further including a club head, said club head includes a club face defining a plane;

said light source and light deflector being positioned to align said luminescent line substantially perpendicular to said plane.

5. The sporting club swing training device of claim 1 wherein said shaft forms part of a golf club further including a club head, said club head includes a club face defining a plane;

said light source and light deflector being positioned to align said luminescent line substantially parallel to said plane.

6. The sporting club swing training device of claim 1 wherein said shaft forms part of a golf club further including a club head, said swing training device further comprising:

a substantially "C" shaped scabbard for affixing said motor, light source and light deflector to said shaft; said "C" shaped scabbard having first and second ends and an intermediate body portion defining an axis, said first and second ends projecting radially with respect to said axis;

said club head projecting radially from said club shaft;

said first and second ends of said "C" shaped scabbard engaging said shaft with said intermediate body portion is aligned substantially parallel to said shaft's axis; and said motor, light source and light deflector being affixed to said "C" shaped scabbard's intermediate body portion.

7. The sporting club swing training device of claim 1 wherein said shaft forms part of a sporting club selected from the group consisting of: a golf club, a baseball bat, a ping pong paddle, a croquet mallet, a tennis racket, and a squash racket.

8. A golf swing training device comprising:

a golf club including a shaft having proximal and distal extremities and a club head projecting radially from said club shaft's distal extremity;

a substantially "C" shaped scabbard having first and second ends and an intermediate body portion, said first and second ends engaging said shaft at said shaft's proximal extremity to form an opening defined by the interior of said "C" shaped scabbard and said shaft, said opening being sized and positioned for receipt of a person's hands so as to enable a person to swing said golf club; said scabbard projecting radially substantially in the same direction as said club head with said intermediate portion being positioned substantially parallel to said shaft's axis; and a light source, light deflector, and motor attached to said intermediate portion of said scabbard, said light source emitting a beam of light in a first direction, said light deflector positioned so that said beam strikes said light deflector to redirect said beam into a second direction; and said motor for rotating said deflector so that said beam in said second direction rotates in a plane, said motor rotating at a velocity sufficient that said beam forms a planar fan of light and appears to form a luminescent line when striking the ground.

9. The golf club swing training device of claim 8 further comprising:

a light deflector positioned so that a beam of light produced by said light source strikes said light deflector to redirect said beam in a second direction; and a motor for rotating said deflector so that said second direction rotates, said motor operating at a velocity sufficient that said beam forms a fan of light and appears to form a luminescent line when striking an object.

* * * * *